US006445143B1

(12) United States Patent
Min

(10) Patent No.: US 6,445,143 B1
(45) Date of Patent: Sep. 3, 2002

(54) INVERTER FOR LCD BACKLIGHT

(75) Inventor: Byoung Own Min, Suwon-Shi (KR)

(73) Assignee: Samsung Electro-Mechanics Co., Ltd., Suwon-chi (KR)

( * ) Notice: Subject to any disclaimer, the term of this patent is extended or adjusted under 35 U.S.C. 154(b) by 0 days.

(21) Appl. No.: 09/855,130

(22) Filed: May 14, 2001

(30) Foreign Application Priority Data

Nov. 28, 2000 (KR) ..... 2000-72621

(51) Int. Cl.[7] ..... H05B 41/36; G09G 3/36
(52) U.S. Cl. ..... 315/307; 345/102
(58) Field of Search ..... 315/169.3, 169.4, 315/244, 209 CD, 209 R, 307, DIG. 4, DIG. 5; 345/102

(56) References Cited

U.S. PATENT DOCUMENTS 5,854,617 A * 12/1998 Lee et al. ..... 345/102
6,069,448 A * 5/2000 Yeh ..... 315/149
6,310,444 B1 * 10/2001 Chang ..... 315/282
6,331,748 B1 * 12/2001 Hong ..... 310/318
6,359,391 B1 * 3/2002 Li ..... 315/291
6,376,999 B1 * 4/2002 Li et al. ..... 315/307

* cited by examiner

*Primary Examiner*—Don Wong
*Assistant Examiner*—Minh D A
(74) *Attorney, Agent, or Firm*—Ladas & Parry

(57) ABSTRACT

An inverter for LCD backlight operates an analog dimming control, a PWM dimming control or a complex dimming control by a control signal set by a manufacturer, and in case of the complex dimming control, realizes an original circuit operated by a controlling method distinguished from the conventional controlling method to enhance responsive characteristics when shifting a dimming mode.

5 Claims, 3 Drawing Sheets

INVERTER FOR LCD BACKLIGHT

BACKGROUND OF THE INVENTION

1. Field of the Invention

The present invention relates to an inverter for LCD backlight, and in particular, to an inverter for LCD backlight that is capable of operating an analog dimming control, a PWM dimming control or a complex dimming control by means of a control signal set by a manufacturer, and in case of the complex dimming control, realizing an original circuit operated by a controlling method distinguished from the conventional controlling method to enhance responsive characteristics when shifting a dimming mode.

2. Description of the Prior Art

In general, an inverter refers to a converting device for converting a direct current to an alternating current. Devices commonly used for an inverter are a combination of a direct current motor with an alternating current power generator, a vibrator or a discharge tube, or a transistor or a thyristor.

Such an inverter is a general power supply exclusively used for a mobile alternating power supply, a fluorescent power supply for a vehicle, an emergency power supply in case of interruption, or a backlight power supply for LCD or other display devices.

The currently available dimming methods of a controller for a backlight inverter are roughly classified into an analog dimming and a PWM dimming that have different circuit structures according to their operations.

Depending on the characteristics of an object to be controlled, any one of the analog dimming method or the PWM dimming method has been used. However, each method has some drawbacks of being unstable.

A complex dimming has been suggested in recent days so that either the analog dimming method or the PWM dimming method can be used, if necessary, by applying both methods. The complex dimming is performed by selectively using all the circuits according to each dimming method.

However, the conventional method described above has a problem of overlap in its construction due to an equipment of both an analog dimming circuit and a PWM dimming circuit, thereby enlarging the volume and complicating a layout in addition to the difficulties in maintenance and repair. Moreover, conversion from the analog dimming to the PWM dimming causes a problem of deteriorating the responsive characteristics.

SUMMARY OF THE INVENTION

It is, therefore, an object of the present invention to provide an inverter for LCD backlight that can eliminate an overlap in a circuit construction and operate with an analog dimming or a PWM dimming by a control signal set by a manufacturer, or can control with a complex dimming to realize an independent circuit in a controlling manner distinguished from the conventional controlling manner to enhance responsive characteristics when converting a dimming mode in a complex dimming control.

To achieve the above object, there is provided an inverter for LCD backlight, comprising: a first switching element connected to an input terminal of a DC/AC converter, which operates a lamp by using an input power, for supplying an input power; a dimming control section for comparing a first dimming signal with a second dimming signal inputted from outside in accordance with a dimming mode selection signal, outputting a first control signal, a second control signal and a third control signal to control a PWM dimming, an analog dimming or a complex dimming control; an error amplifier for receiving a feedback signal F/B of a feedback part connected to the lamp by means of an inverting terminal, and receiving the first control signal outputted from the dimming control signal by means of a non-inverting terminal to output a compared signal in accordance with a state of a signal inputted to each terminal; a first comparator for receiving a third control signal outputted from a pyramidal wave for controlling the PWM dimming having a predetermined cycle or the third control signal outputted from the dimming control section by means of the non-inverting terminal, receiving the second control signal outputted from the dimming control section by means of the non-inverting terminal so as to be compared with the third control signal and output a signal based on the resultant value; a second switching element connected between an output terminal of the error amplifier and a ground terminal for performing on/off operations in accordance with a voltage level of a signal outputted from the first comparator, and converting a potential of the output terminal of the error amplifier to a ground potential during the "on" operation; and a second comparator for receiving the output signal from the error amplifier by means of the non-inverting terminal, receiving an oscillating signal of a predetermined cycle through the non-inverting terminal so as to be compared with the output signal from the error amplifier, and control on/off operations of the first switching element in accordance with the resultant value.

In the inverter for LCD backlight according to the present invention, the dimming control section comprises: comparing means for comparing the first dimming signal with a reference signal, outputting the compared signal to consider a state of the second dimming signal connected to the output terminal or a state of an output signal by feeding back the output signal thereof; second control signal generating means for controlling a state of the second control signal by reference to the signal loaded at the output terminal of the comparing means so as to be applied to an input terminal of inverting data of the first comparator; mode selecting means for controlling a state of the third control signal by means of the mode selection signal, and adjusting a state of the first control signal; and first control signal generating means for generating a signal to distinguish an analog dimming from a PWM dimming by means of the mode selection signal outputted from the mode selecting means, and generating a first control signal so as to be applied to a non-inverting data input terminal of the error amplifier.

In the inverter for LCD backlight according to one aspect of the present invention, when the dimming control section operates in the analog dimming mode by means of he mode selection signal, the third control signal has a ground potential by means of the mode selecting means, and the first control signal and the second control signal output lineally escalating signals so that the second comparator in charge of on/off of the first switching element can be controlled by the output signal of the error amplifier.

In the inverter for LCD backlight according to another aspect of the present invention, when the dimming control section operates in the PWM dimming mode by means of the mode selection signal, the third control signal has a potential of a high level by means of the mode selecting means, and the first control signal has a potential of a high level by means of the first control signal generating means, while the second control signal outputs lineally escalating signals by means of the second control signal generating means so that the second comparator in charge of on/off of the first switching element can be controlled by the second switching means operated on/off under a control by the first comparator.

In the inverter for LCD backlight according to another aspect of the present invention, when the dimming control section operates in a complex dimming control mode by means of the mode selecting signal, the third control signal has a potential of a high level by means of the mode selecting means, and the second control signal outputs lineally escalating signals by means of the second control signal generating means, while the first control signal lineally elevates in a ground potential state at a predetermined point of time by means of the first control signal generating means so that the first control signal operates in a PWM dimming control mode under a ground potential state, and that the first control signal operates in an analog dimming control mode in a lineally escalating interval.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
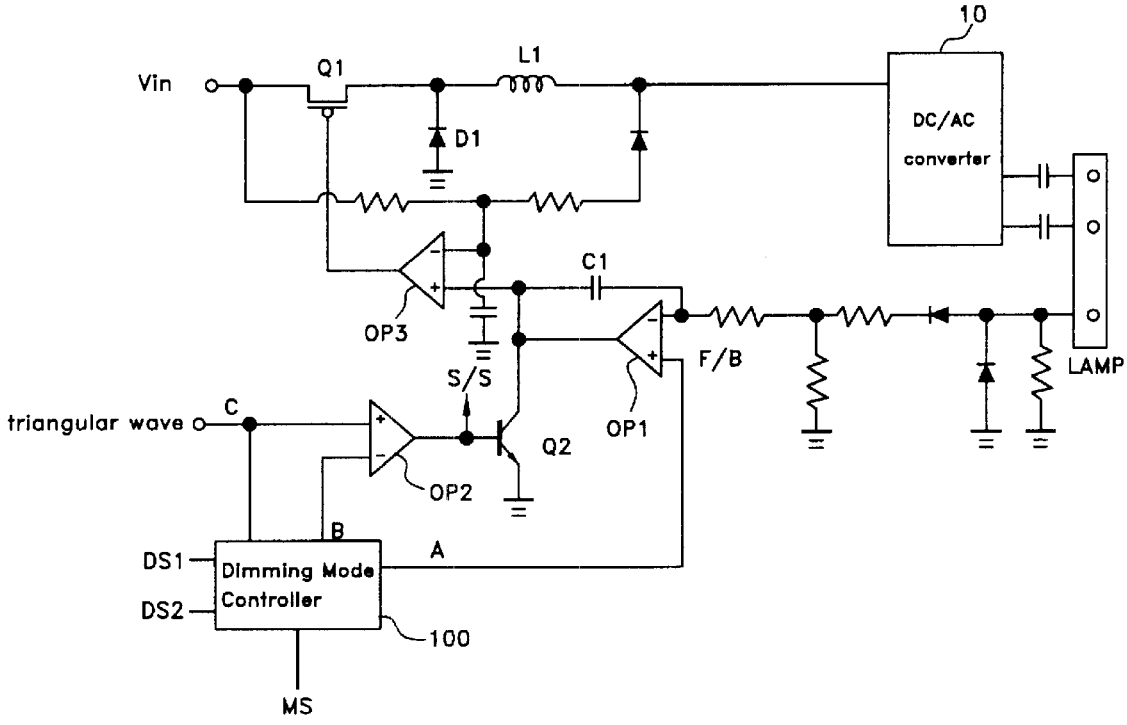
FIG. 1 is a circuit diagram illustrating a construction of an inverter for LCD backlight according to the present invention.

A preferred embodiment of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

FIG. 1 is a circuit diagram illustrating a construction of an inverter for LCD backlight according to the present invention.

Referring to FIG. 1, the inverter for LCD backlight comprises a DC/AC converter 10 for performing a voltage transformation and operating a lamp, and a buck switch Q1 connected between an operational power Vin and the DC/AC converter 10 for applying the operational power Vin to the DC/AC converter 10 by performing on/off operations in accordance with an inputted control signal.

The on/off control of the buck switch Q1 is performed by a dimming control. A dimming mode control section identified by the drawing reference numeral 100 in FIG. 1 performs a PWM dimming control, an analog dimming control and a complex control according to the present invention. The drawing reference numeral OP1 in FIG. 1 refers to an error amplifier for receiving a feedback signal F/B of the feedback part connected to a lamp by means of an inverting □terminal and a signal A outputted from a first output terminal of the dimming control section 100 by means of a non-inverting+terminal, and comparing the feedback signal F/B with the signal A so as to output a compared result.

The drawing reference numeral C1 refers to a capacitor connected to an output terminal of the error amplifier OP1 and the non-inverting terminal. The drawing reference numeral OP3 refers to a second comparator for receiving an output signal of the error amplifier OP1 through the non-inverting+terminal and receiving an oscillating signal of an oscillator through the inverting−terminal so as to compare the two signals and control on/off operations of the buck switch Q1 in accordance with the compared result.

The drawing reference numeral Q2 refers to a transistor for performing a function of a switching element by being connected between the output terminal and the ground terminal of the error amplifier OP1. The drawing reference numeral OP2 refers to a first comparator for receiving a pyramidal wave having a predetermined cycle by means of the non-inverting+terminal, receiving a signal B outputted from the second output terminal of the dimming mode control section 100, comparing the two signals, and supplying the compared signal to a base terminal of the transistor Q2 so that the output signal of the error amplifier OP1 can be switched on/off by switching on/off the transistor Q2.

An operation of the present invention having the above construction will now be described with reference to FIGS. 2 to 5.

An F/B terminal determines an output of the error amplifier OP1 by converging the voltage outputted from the first output terminal A of the dimming control section 100 in accordance with the range of the voltage. The dimming control section 100 controls the signal waveforms (refer to the drawing reference numerals a, b in FIGS. 2 to 4) outputted from the first output terminal A and the second output terminal B thereof in accordance with the input conditions of the first dimming signal or the second dimming signal so as to be operated within the analog dimming range or the PWM dimming range.

An analog dimming operation will now be described with reference to FIG. 2.

If the voltage loaded on the mode selecting terminal MS of the dimming control section 100 is selected to be a ground potential, the dimming control section 100 recognizes the ground potential as an analog dimming mode, and outputs lineally escalating signals as identified by the drawing reference numerals "a" and "b" at the first output terminal A and the second output terminal B in accordance with variation of the first dimming signal DS1 or the second dimming signal DS2.

Therefore, the pyramidal wave (the drawing reference numeral "c" in FIG. 2) is loaded as a ground potential to operate the PWM applied to the non-inverting data input terminal+of the first comparator OP2. The output of the error amplifier OP1 is controlled by the signal (the drawing reference numeral "a" in FIG. 2) outputted from the first output terminal A of the dimming control section 100 when Q2 is off.

Subsequently, the output signal of the second comparator OP3 for controlling on/off of the buck switch Q1 is controlled by the signal (identified by the drawing reference numeral OSC in FIG. 2) applied to the inverting terminal of the second comparator OP3.

Figure 2:
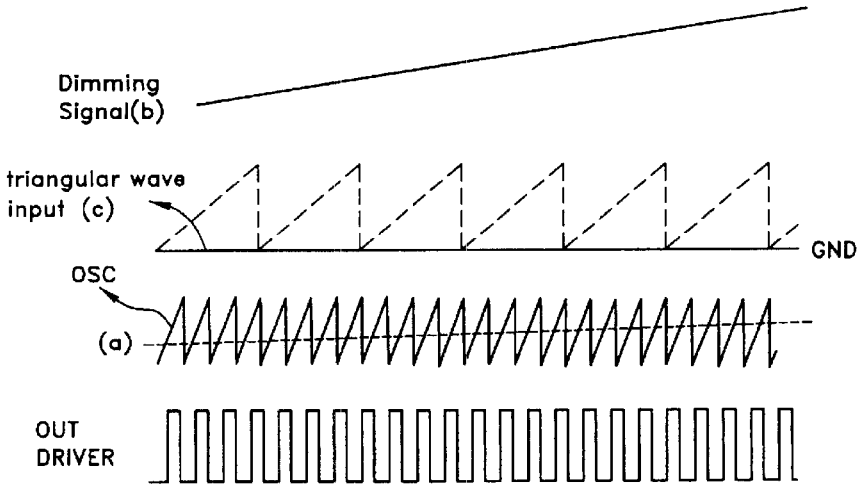
FIG. 2 is an exemplary diagram illustrating a timing of an analog dimming operation according to the present invention.

Thus, a pulse signal having a regular cycle is generated as a device output signal, as shown in FIG. 2, to perform an analog dimming control.

A PWM dimming operation will now be described with reference to FIG. 3.

Figure 3:
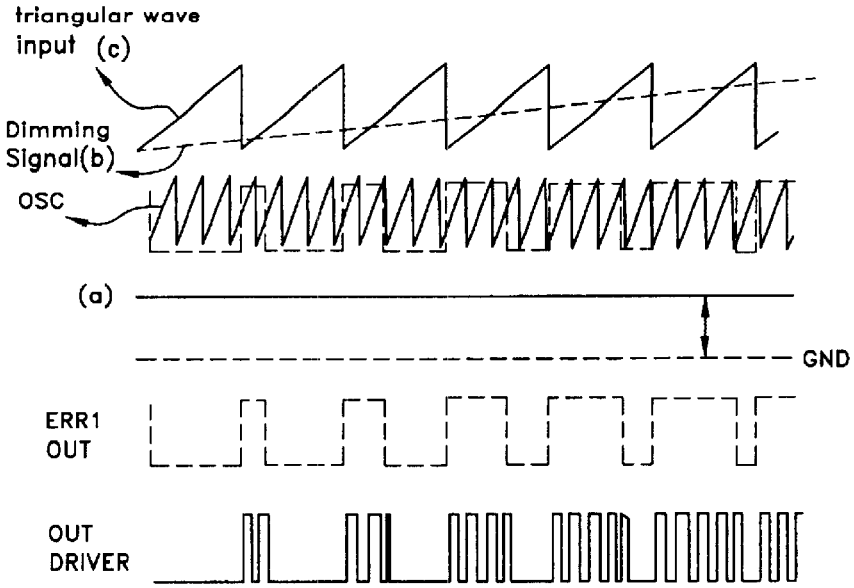
FIG. 3 is an exemplary diagram illustrating a timing of a PWM dimming operation according to the present invention.

If the voltage loaded on the mode selecting terminal MS of the dimming control section is selected as a reference potential, the dimming control section 100 recognizes the reference potential as a PWM dimming mode, and outputs signals varying as identified by the drawing reference numerals "a" and "b" in FIG. 3 at the second output terminal B.

In other words, the signal "a" outputted from the first output terminal A maintains the voltage of a high level, while the signal "b" outputted from the second output terminal B is lineally varied.

As a consequence, the pyramidal wave (identified by the drawing reference numeral "c" in FIG. 3) is of a waveform having a substantially regular cycle to perform the PWM operation applied to the non-inverting data input terminal+of the first comparator OP2. The output signal of the first comparator OP2 does takes a waveform of a synthesized pulse rather than of a regular cycle due to the signal "b" outputted from the lineally escalating second output terminal B.

The output of the error amplifier OP1 is always in a high state due to the signal "a" outputted from the first output terminal A. Therefore, the signal actually applied to the non-inverting data input terminal of the second comparator OP3 is variable in accordance with the on/off operation of the transistor Q2.

To be specific, the transistor Q2 is switched on/off by the output signal of the first comparator OP2. As a consequence, the signal applied to the non-inverting data input terminal of the second comparator OP3 is referred to "ERR1 OUT" in FIG. 3.

Therefore, the output signal of the second comparator OP3 for controlling on/off of the buck switch Q1 is controlled by a value comparing the signal (identified by the drawing reference numeral OSC in FIG. 3) applied to the inverting terminal of the second comparator OP3 with the signal (identified by the drawing reference numeral ERR1 OUT in FIG. 3) applied to the non-inverting data input terminal of the second comparator OP3.

As a result, a pulse signal referred to as an "OUT DRIVER" in FIG. 3 is outputted to perform a PWM dimming control.

A complex dimming control will now be described with reference to FIGS. 4 and 5.

The F/B terminal determines an output of the error amplifier OP1 by converging the voltage outputted from the first output terminal A of the dimming control section 100 in accordance with the range of the voltage. The dimming control section 100 controls the signal waveforms "a" and "b" outputted from the first output terminal A and the second output terminal B of the dimming control section 100 in accordance with the input conditions of the first dimming signal or the second dimming signal so as to be operated in the analog dimming range or the PWM dimming range.

The pyramidal wave applied to the non-inverting data input terminal+of the first comparator OP2 is a waveform generated to operate the PWM in the PWM dimming range. When operated in the analog dimming range due to variation of the first dimming signal or the second dimming signal, the signals "a" and "b" outputted from the first output terminal A and the second output terminal B are lineally varied to control an output of the error amplifier OP1.

When operated in the PWM dimming range due to variation of the first dimming signal or the second dimming signal, the signal "b" outputted from the second output terminal B lineally operates, while the signal "a" outputted from the first output terminal A operates under a predetermined voltage so as to control an output of the error amplifier OP1. Therefore, the output of the first comparator OP2 performs a PWM operation with the on/off operation of the first switch Q1 in accordance with the duty variation of a circular wave.

Figure 4:
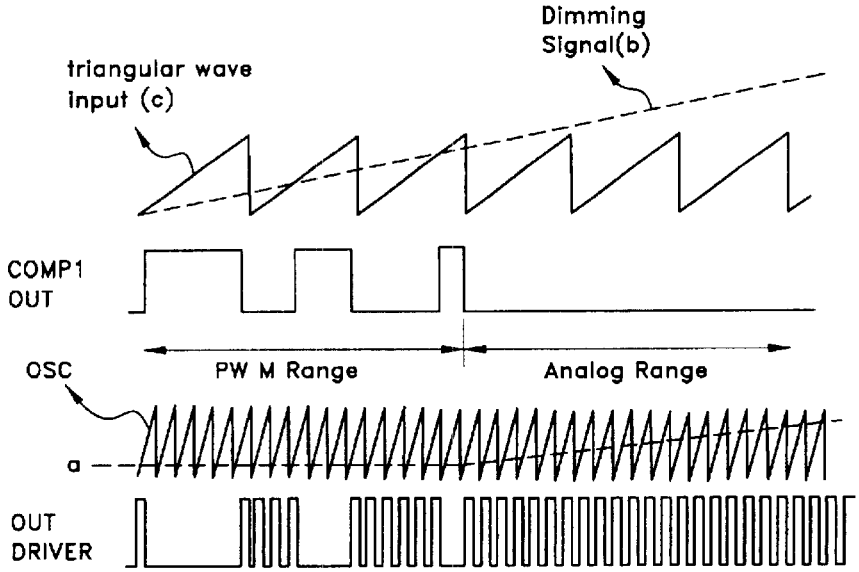
FIG. 4 is a diagram illustrating a timing of a complex dimming operation according to the present invention.

FIG. 4 shows chronological variation of the dimming signal in the PWM operational range and the analog operational range. FIG. 5 shows the dimming control section according to an embodiment of the present invention. When Q3 is switched off, the potential of the signal outputted from the first output terminal A is fixed due to the resistance ratio between the first resistor R1 and the second resistor R2, and Q3 operates in the PWM dimming range from this stage.

Figure 5:
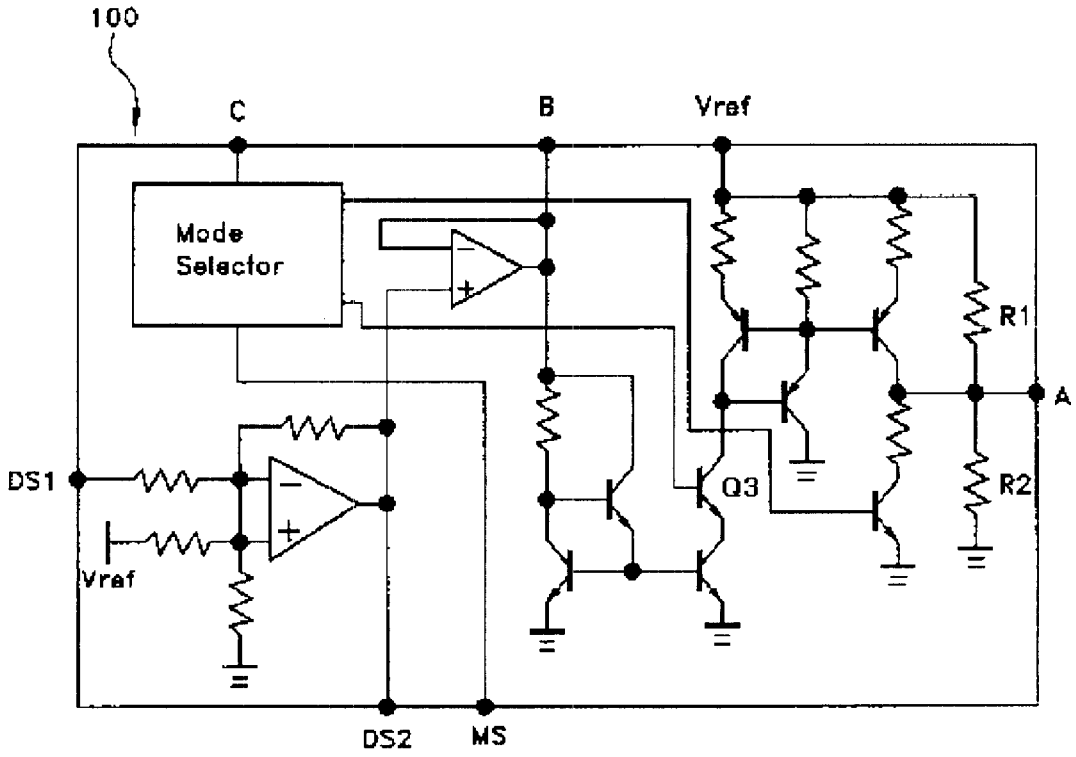
FIG. 5 is an exemplary diagram illustrating a dimming mode control section in FIG. 1.

On the other hand, when the switching element identified as Q3 in FIG. 5 is switched on, the potential of the signal "a" outputted from the first output terminal A is varied, and Q3 operates in the analog dimming range from this stage.

In short, as shown in FIG. 4, the dimming signal "b" of the lineal state performs the PWM dimming control until the point of time when the compared value, which is an output signal of the first comparator OP2 compared with the pyramidal wave of a regular cycle, is converted from a pulse to a ground potential. From the moment when the output signal of the first comparator OP2 has the ground potential, the dimming signal "b" follows the analog dimming control method.

Substantially, the point of time requiring the analog dimming is detected by reference to the dimming signal "b" and the pyramidal wave of a lineal state. The potential of the signal "a" outputted from the first output terminal A of the dimming control section 100 is varied at the point of detecting time. As a consequence, Q3 operates in the analog dimming range.

FIG. 5 is a schematic view showing an example of a minimum construction, rather than an actual construction, of an integrated circuit to perform a function of controlling the dimming mode control according to the present invention. Referring to FIG. 5, the integrated circuit comprises: a comparator for comparing the first dimming signal DS1 with a reference signal, outputting the compared signal and feeding back the signal state of the second dimming signal DS2 connected to the output terminal or the output signal per se to consider the state of the output signal; a first circuit section for controlling the state of a signal outputted to the second output terminal B by reference to the signal loaded on the output terminal of the comparator; a mode selecting section for controlling the state of a signal outputted to the third output terminal C b means of a mode selection signal MS, and controlling the state of an output signal from the first output terminal A; and a second circuit section for generating a signal to distinguish the analog dimming from the PWM dimming by means of the mode selection control signal so as to be outputted through the fist output terminal A.

The above construction is a description made from the functional point of view without considering any drawing reference numerals in FIG. 5. Such a construction can be realized with a microcomputer, and a detailed cooperative relationship will be omitted here.

As described above, the inverter for LCD backlight according to the present invention has advantageous effects of realizing a PWM dimming and an analog dimming by switching on/off an error amplifier without switching on/off an IC power as well as of stabilizing a circuit by reducing variation of the power and enhancing reliability of the IC.

While the invention has been shown and described with reference to a certain embodiment thereof, it will be understood by those skilled in the art that various changes in form and details may be made therein without departing from the spirit and scope of the invention as defined by the appended claims.

What is claimed is:

1. An inverter for LCD backlight, comprising:

a first switching element connected to an input terminal of a DC/AC converter operating a lamp by using an inputted power for determining supply of the inputted power;

a dimming control section for comparing a first dimming signal with a second dimming signal inputted from outside in accordance with a dimming mode selection signal, and outputting first to third control signals to perform a PWM dimming, an analog dimming or a complex dimming control;

an error amplifier for receiving a feedback signal F/B of a feedback part connected to the lamp by means of an inverting terminal, and a first control signal outputted from the dimming control section by means of a non-inverting terminal to output a compared signal in accordance with a state of the signals inputted to each terminal;

a first comparator for receiving a pyramidal wave for controlling the PWM dimming having a predetermined cycle or a third control signal outputted from the dimming control section by means of the non-inverting terminal, and a second control signal outputted from the dimming control section by means of the inverting terminal, comparing the two signals, and outputting a signal in accordance with a compared value;

a second switching element connected between an output terminal of the error amplifier and a ground terminal for performing on/off operation in accordance with a voltage level of a signal outputted from the first comparator, and converting a potential of the output terminal of the error amplifier to a ground potential; and a second comparator for receiving the output signal of the error amplifier by means of the non-inverting terminal and an oscillating signal of a predetermined cycle by means of the inverting terminal, and comparing the two signals to control on/off operations of the first switching element in accordance with the compared result.

2. The inverter for LCD backlight of claim 1, wherein the dimming control section comprises:

comparing means for comparing the first dimming signal with a reference signal, outputting the compared signal, and feeding back a state of the second dimming signal to an output terminal;

second control signal generating means for controlling a state of the second control signal by reference to a signal loaded on the output terminal of the comparing means so as to be applied to an inverting data input terminal of the first comparator;

mode selecting means for controlling a state of the third control signal by means of the mode selection signal and a state of the first control signal; and first control signal generating means for generating a signal to distinguish the analog dimming from the PWM dimming by means of the mode selection control signal, and generating the first control signal so as to be applied to a non-inverting data input terminal of the error amplifier.

3. The inverter for LCD backlight of claim 2, wherein the third control signal has a ground potential by means of the mode selecting means when operated in a dimming mode by means of the mode selection signal, and the first control signal and the second control signal outputted from the second control signal generating means outputs lineally escalating signals so that the second comparator in charge of on/off operations of the first switching element can be controlled by the output signal of the error amplifier.

4. The inverter for LCD backlight of claim 2, wherein the third control signal has a potential of a high level by means of the mode selecting means when operated in the PWM dimming mode by means of the mode selection signal, the first control signal has a potential of a high level by means of the first control signal generating means, and the second control signal outputs a lineally escalating signal by means of the second control signal generating means so that the second comparator in charge of on/off operations of the first switching element can be controlled by the second switching means operated on/off in accordance with the first comparator.

5. The inverter for LCD backlight of claim 2, wherein the third control signal has a potential of a high level by means of the mode selecting means when operated in a complex dimming control mode by means of the mode selection signal, the second control signal outputs a lineally escalating signal by means of the second control signal generating means, and the first control signal is lineally escalated at a predetermined point of time in a ground potential state by means of the first control signal generating means so as to be operated in a PWM dimming control mode when the first control signal is in the ground potential state, and be operated in an analog dimming control mode with respect to the interval, in which the first control signal lineally escalates.

* * * * *